United States Patent [19]

Takano et al.

[11] 4,407,228

[45] Oct. 4, 1983

[54] DEVELOPING APPARATUS

[75] Inventors: Toshimasa Takano, Sagamihara; Hideo Mukai; Masahiro Hosoya, both of Yokohama, all of Japan

[73] Assignee: Tokyo Shibaura Denki Kabushiki Kaisha, Kawasaki, Japan

[21] Appl. No.: 308,791

[22] Filed: Oct. 5, 1981

[30] Foreign Application Priority Data

Oct. 6, 1980 [JP] Japan ..... 55-139627

[51] Int. Cl.[3] ..... G03G 15/06

[52] U.S. Cl. ..... 118/651; 118/656

[58] Field of Search ..... 118/656, 651

[56] References Cited

U.S. PATENT DOCUMENTS 4,273,069 6/1981 Huggins et al. ..... 118/656 X

*Primary Examiner*—Bernard D. Pianalto

*Attorney, Agent, or Firm*—Cushman, Darby & Cushman

[57] ABSTRACT

A developing apparatus is used with an image forming system provided with a photosensitive layer on which a static latent image is impressed and which is formed of first and second portions having different surface potentials. The developing apparatus comprising a developing roller which is rotatably arranged and fitted with a large number of hairs for feeding a developing agent such as a toner to the surface of the photosensitive layer in contact therewith. The developing agent is attracted to the first portion of the surface of the photosensitive layer with a strong attractive force and to the second portion of the surface with a weak attractive force. The developing apparatus further comprises electrode tube for removing that portion of the developing agent which is attracted to the second portion with the weak attractive force.

22 Claims, 12 Drawing Figures

DEVELOPING APPARATUS

BACKGROUND OF THE INVENTION

This invention relates to a developing apparatus for an image forming machine, and more particularly to a developing apparatus used with a dry type electrostatic copying machine applying a toner as a developing agent.

A large variety of developing apparatus have generally been proposed for a dry type electrostatic copying machine. Most of the proposed developing apparatuses which are practically applied are of the type in which a magnetic roller is set in the body of the dry type electrostatic copying machine; a magnetic toner, that is, the so-called one-component toner or a 2-phase mixture of a carrier (magnetized powder) and toner held in a toner feeder is adsorbed to the magnetic roller; the adsorbed mass acts as a magnetic brush; and the magnetic brush is made to slide over a sensitized layer, thereby transferring a required quantity of a magnetic toner or toner onto the sensitized layer. However, a toner feeding system whose main component is formed of the above-mentioned magnetic roller has the drawbacks that the required magnetic roller is expensive, presenting difficulties in reducing the manufacturing cost of a dry type electrostatic copying machine as a whole; a space between the peripheral surface of the magnetic roller and a photosensitive body has to be adjusted minutely, often with a precision of the order of about 0.1 mm; if an attempt is made to meet this space precision requirement, then a dry type electrostatic copying machine would involve a complicated arrangement; and the one-component toner in particular noticeably tends to demand a more rigid requirement for the above-mentioned space precision.

On the other hand, another proposed developing apparatus in which a toner is supplied by means of a carrier has the drawbacks that the carrier itself has a limited life, namely, has to be replaced by a fresh one, each time an impression is made on, for example, 10,000 to 20,000 copy sheets; and the replacement has to be undertaken, for example, by a maintenance service man, the often consumes a great deal of work and time.

Recently, therefore, a new developing apparatus has been proposed which uses an inexpensive fur brush roller. With one type of a fur brush roller developing apparatus (FIG. 1), long hairs 12 are fitted to the peripheral surface of the fur brush roller 10. The long hairs 12 stroke the surface of a photosensitive layer 14 to adsorb a toner 16 to the surface, thereby carrying out development.

With another type of the fur brush roller developing apparatus (FIG. 2), short hairs 20 are fitted to the peripheral surface of a fur brush roller 18, whose core 22 is made of soft material. Those portions of the peripheral surface of the fur brush roller 18 which contact the surface of the photosensitive layer 14 are made to flex to adsorb the toner 16 to the surface of the photosensitive layer 14, thereby carrying out development.

However, the first mentioned prior art fur brush roller developing apparatus has the drawbacks that the long hairs 12 attached to the fur brush rollers 10 are thrown flat during long application periods, reducing contact between the long hairs 12 and the surface of the photosensitive layer 14, and deteriorating the quality of a printed impression due to the reduced distinctiveness and blurring of the impression; the long hairs 12 have an increased electric resistance, preventing bias voltage for fog-free development from being fully impressed on the surface of the photosensitive layer 14, resulting in the failure to give full play to the fog-suppressing effect of the bias voltage; the smoky scattering noncharged excess toner by the rotation of the fur brush roller 10 leads noticeable fogging; and consequently a separate fog-preventing roller 24 has to be additionally provided, thereby complicating the arrangement of the first mentioned fur brush roller developing apparatus.

For the effective suppression of fogging by the development bias voltage in the latter type of the conventional fur brush roller developing apparatus, the particles of the toner 16 held between the short hairs 20 should be fully charged by friction between the toner particles 16 and hairs 20, and further a prescribed amount of the toner 16 should be supplied. Where sufficient friction does not take place between the short hairs 20 and toner particles 16, and further an excess amount of the toner 16 is supplied, then a certain portion of the toner 16 fails to contact the short hairs 20, causing an increased amount of toner particles 16 to remain noncharged. The noncharged toner particles 16 lead to fogging. Conversely, an insufficient amount of toner particles 16 results in a decline of the density of an impressed pattern. Consequently, as shown in FIG. 2, a toner charging roller 28 and toner feeding roller 30 have to be additionally provided, complicating the arrangement of the latter type of prior art fur brush roller developing apparatus. Moreover, the required simultaneous rotation of the respective rollers 18, 28, 30 demands the provision of a powerful motor, unavoidably increasing the cost of the developing apparatus.

SUMMARY OF THE INVENTION

This invention has been accomplished in view of the above-mentioned circumstances and is intended to provide a developing apparatus used with a copying machine, the developing apparatus being so designed that those portions of a developing agent which settle on the surface portions of a photosensitive layer on which a static latent image is not impressed can be reliably taken off by simple means, thereby suppressing the occurrence of fogging.

DETAILED DESCRIPTION OF THE PREFERRED EMBODIMENTS

Figure 1:
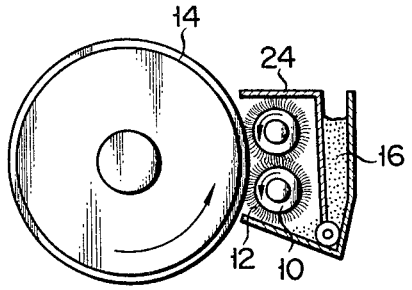
FIG. 1 (PRIOR ART)
FIGS. 1 and 2 schematically illustrate the arrangements of different types of conventional hair brush roller developing apparatus.
Figure 2:
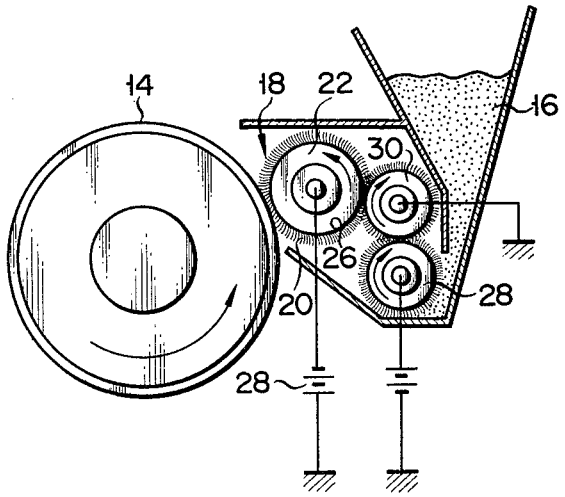
FIG. 2 (PRIOR ART)
Figure 3:
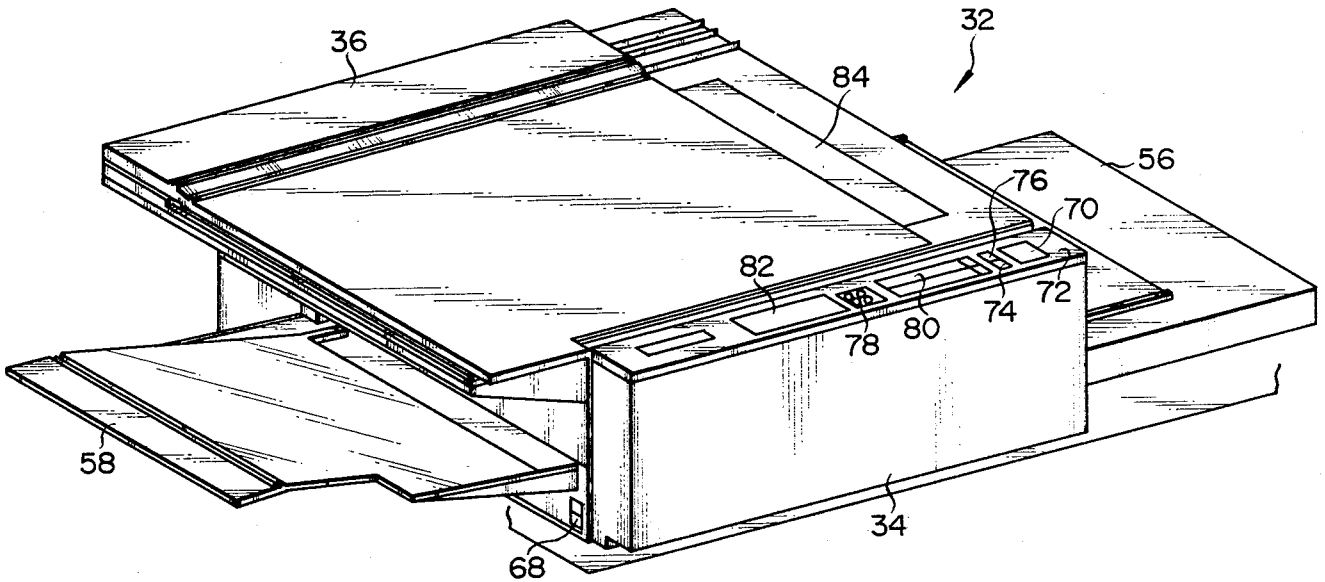
FIG. 3 is an oblique view of an electrostatic copying machine provided with a developing apparatus according to one embodiment of this invention.
Figure 4:
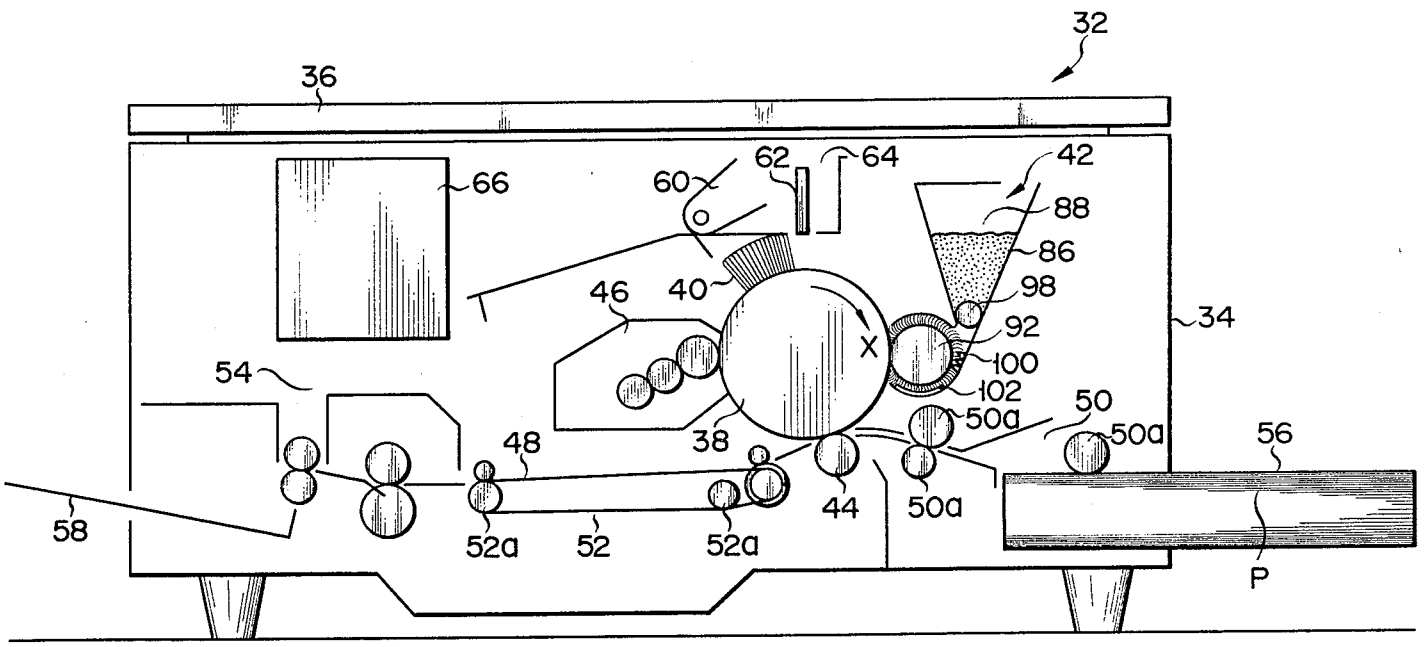
FIG. 4 schematically indicates the arrangement of an electrostatic copying machine of FIG. 3.

Description is now given of a developing apparatus embodying this invention with reference to FIGS. 3 to 9 appended hereto. As shown in FIGS. 3 and 4, an electrostatic copying machine 32 has a body 34. A reciprocative original table 36 is mounted on the body 34. A photosensitive drum 38 is supported substantially at the center of the machine body 34 in a state rotatable in a directed indicated by an arrow X. The photosensitive drum 38 is constructed by a mounting a negatively chargeable cylindrical photosensitive layer 38*b* of zinc oxide series on the peripheral surface of an aluminum cylindrical member 38*a*. Arranged in contact with the photosensitive layer 38*b* of the photosensitive drum 38 are a charging device 40, developing apparatus 42, transcription roller 44 and clearing device 46 in the order mentioned as counted in the rotating direction of the photosensitive drum 38. Set in the lower part of the interior of the machine body 34 is a copy sheet-feeding path 48 along which a copy sheet is carried over the periphery of the transcription roller 44 lengthwise of the machine body 34. Arranged along the copy sheet-feeding path 48 are a copy sheet-feeding mechanism 50 comprising a plurality of copy sheet-feeding rollers 50*a*, the aforesaid transcription roller 44, a plurality of copy sheet-discharging rollers 52*a* and fixing device 54 in the order mentioned as counted from the base side of the copy sheet-feeding path 48. A copy sheet-feeding cassette 56 is detachably provided on that side of the machine body 34 which faces the base side of the copy sheet-feeding path 48. Provided at the outward extending end of the copy sheet-feeding path 48 is a copy sheet-discharging tray 58, which is detachably fitted to the machine body 34. Character P denotes copy sheets received in the cassette 56. Set in the interior upper portion of the machine body 34 is an exposure device 64 including an optical fiber lens 62 and an illumination system 60 having an illumination lamp.

Received in the machine body 34 is drive motor 66 which actuates the above-listed constituent members of the copying machine; rotates the photosensitive drum 38 clockwise of FIG. 4 at a circumferential speed of, for example, 80 mm/s, and further causes the original table 36 to reciprocate in synchronization with the rotation of the photosensitive drum 38. Provided on the outside of the machine body 34 (see FIG. 3) are a main switch 68 and control panel 72. The control panel 72 comprises a copy button 70, copy density-increasing button 74, copy density-reducing button 76, copy sheet number-defining button 78 and copy sheet number display window 80 and a window 82 for displaying the current condition of the copying machine 32. The machine body 34 is further provided with an opening 84 through which the developing device 42 is fitted to the interior of the machine body 34. The developing device 42 is described later in greater detail.

Where copying is carried out by the electrostatic copying machine 32 arranged as described above, the main switch 68 is first rendered conducting and an original (not shown) is set on the original table 36. The various buttons on the control panel 72 are actuated to handle copy sheets in accordance with the modes with which an impression is to be made on the copy sheets. The reciprocation of the original table 36, the rotation of the photosensitive drum 38 and the operation of the various constituent members of the copying machine 32 are carried out in accordance with the manner in which the copy sheets are handled.

The original mounted on the original table 36 is illuminated by the illumination system 60. An impression appearing on the original is focused on the cylindrical photosensitive layer 38*b* through the optical fiber lens 62. The charging device 40 negatively charges the cylindrical photosensitive layer 38*b* of the photosensitive drum 38. A light corresponding to the impression on the original is illuminated on the negatively charged photosensitive layer 38*b* through the optical fiber lens 62. Reflections from the white portions of the original are sent back on the photosensitive layer 38*b*. That portion of the photosensitive layer 38*b* (FIG. 5) which is exposed to the light (the second portion) is rendered conducting. As a result, the surface of the second portion has a potential of substantially zero volt. On the other hand, light beams projected on the dark portions of the original are absorbed therein and are not carried to the photosensitive layer 38*b*. That portion of the photosensitive layer 38*b* which is not exposed to light beams (the first portion) remains insulated. The surface of the first portion of the peripheral surface of the photosensitive layer 38*b* retains a prescribed negative potential. A static latent image is formed on the photosensitive layer 38*b* which is now formed of the above-defined first and second portions. The latent image is developed into a toner image by the developing device 42. The toner image is brought to the transcription roller 44. The copy sheet feeding mechanism 50 causes copy sheets P to be taken out of the cassette 56 one after another. The drawn out copy sheet P is transported to a transcription contact face defined between the transcription roller 44 and photosensitive layer 38*b* along the copy sheet-feeding path 48. The toner image is transcribed on the copy sheet P at the transcription roller 44. The copy sheet P on which the toner image has been transcribed is guided to the fixing device 54 for fixation by the copy sheet-discharging mechanism 52. Thereafter, the fixed copy sheet P is transported to the discharge tray 58 in the completed form. After the transcription process, the cylindrical photosensitive layer 38*b* is fully cleaned by the cleaning device 46 and gets ready for the succeeding charging process.

With the above-mentioned copying process, the cylindrical photosensitive layer 38*b* of the photosensitive drum 38 contacts the surrounding devices taking part in the copying process. However, the photosensitive layer 38*b* which is formed of a mechanically strong photoconductive membrane prepared from a material of the zinc oxide series is not subject to any damage.

Figure 5:
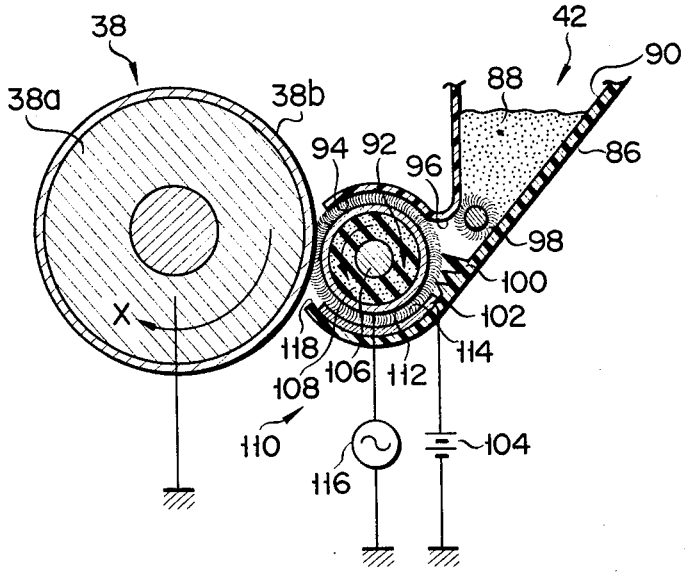
FIG. 5 schematically sets forth the arrangement of the developing apparatus according to the embodiment of FIG. 3.

The developing device 42 is arranged as shown in FIG. 5. A toner hopper 90 for holding a toner 88 is formed in the interior upper portion of a housing 86 of the developing device 42. A developing roller chamber 94 for holding a developing roller 92 is provided in the interior lower portion of the housing 86. A constricted communication chamber 96 is provided to connect together the toner hopper 90 and developing roller chamber 94. The housing 86 of the developing device 42 is open at the top, but is normally covered with a cap (not shown). The toner 88 is filled in the toner hopper 90 by removing the cap. The toner is formed of the particles of carbon and thermoplastic resin whose diameter distribution is centered at 10 microns. A toner-feeding roller 98 is rotatably supported in the communication chamber 96 in a state to close the upper end portion thereof. The toner-feeding roller 98 is rotated clockwise of FIG. 5 by a drive mechanism (not shown). The upper half portion of the toner-feeding roller 98 is held in the toner hopper 90, and the lower half portion of the toner-feeding roller 98 is held in the developing roller chamber 94. The toner 88 received in the toner hopper 90 is discharged into the underlying developing roller chamber 94 by the rotation of the toner-feeding roller 98.

Figure 6:
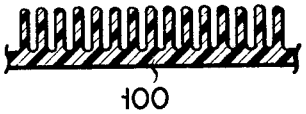
FIG. 6 is a front view of a toner quantity-controlling blade used with the developing apparatus of FIG. 5.

The upper plane of the bottom wall of the housing 86 lying below the communication chamber 96 defines a toner-feeding path extending from the toner hopper 90 to the developing roller 92. The toner-feeding path is provided with a plurality of toner quantity-controlling blades 100. Each toner quantity-controlling blade 100 is shaped like a comb as shown in FIG. 6. The plural toner quantity-controlling blades 100 prevent the toner 88 taken into the developing roller chamber 94 by the toner-feeding roller 98 from being supplied to the later described electrode plate 102 at once. In other words, the plural comb-shaped blades 100 enable the toner 88 to be continuously supplied at a prescribed rate to the electrode plate 102 for forcibly charging the toner 88. The electrode plate 102 is positioned in that portion of the toner-transporting path which lies downstream of the plural toner quantity-controlling blades 100 as viewed from the traveling direction of the toner 88. The electrode plate 102 is connected to a D.C. source 104. Therefore, the toner 88 which contacts the electrode plate 102 is forcibly charged to a sufficient extent for development. Since the photosensitive layer **38*b* is prepared from zinc oxide as previously described, a static latent image is negatively charged. Therefore, the electrode plate 102 is impressed with positive D.C. voltage in order to let the toner 88** remain positively charged.

Figure 7A:
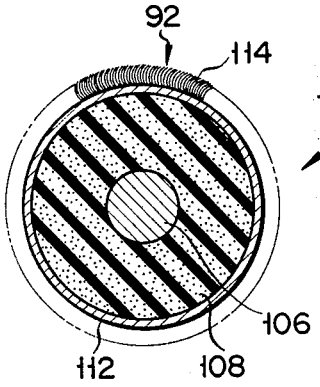
FIGS. 7A and 7B are respectively the cross sectional and lateral views of the developing fur brush roller used with the developing apparatus of FIG. 5.
Figure 7B:
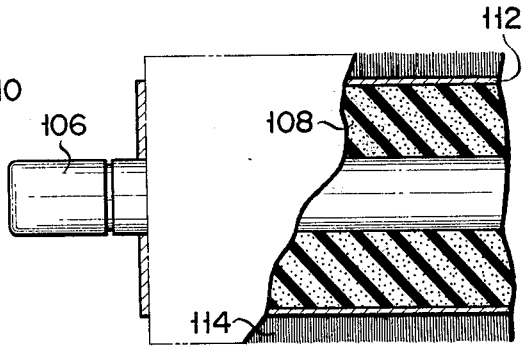

Description is now given with reference to FIGS. 7A and 7B of the arrangement of the developing roller 92 embodying this invention. Reference numeral 106 denotes a rotary shaft whose core is made of aluminum or stainless steel. The outer peripheral surface of the rotary shaft 106 is covered with a foamed polyurethane layer 108, for example EMM polyurethane (trade name: MTP KASEI K.K.) having a prescribed thickness. Therefore, the cylindrical core member 110 of the developing roller 92 has prominent elasticity. The EMM polyurethane foam used with a developing apparatus embodying this invention is chosen to have a hardness of 23±5 kg, and a rebound elasticity than 45% (as determined by the test method defined in JIS specification K-6401).

The core member 110 of the developing roller 92 has its peripheral surface surrounded by an electrode tube 112 used as means for suppressing fogging. The electrode tube 112 is formed of a conductive rubber tube with a lower specific electric resistance than the later described hairs 114 taken as a whole. The electrode tube 112 is connected to an A.C. source 116, which impresses A.C. voltage having a frequency of about 1 kHz on a space defined between the electrode tube 112 and photosensitive drum 38. The electrode tube 112 is attached to the peripheral surface of the core member 110 of the developing roller 92 by means of conductive adhesive.

A larger number of hairs 114 are erected on the outer peripheral surface of the electrode tube 112. Each hair 114 is formed of a special wear-resistant rayon fiber which contains carbon, is physically treated for electric conduction, has a length of 1.5 mm, a thickness of 1.5 denier, and indicates electric resistance of $10^3$ to $10^7$ (Ω.cm). All the hairs 114 are statically implanted over the whole peripheral surface of the electrode tube 112.

The developing roller 92 constructed as described above is rotatably supported in the chamber 94 in connection to a drive means (not shown). The developing roller chamber 94 is shaped substantially like a cylinder. The inner wall of the chamber 94 and electrode plate 102 are lightly touched by the distal end portions of the hairs 114 of the developing roller 92. An opening 118 is formed in that portion of the housing 86 defining the developing roller chamber 94 which faces the cylindrical photosensitive layer **38*b*. The distal end portions of the hairs 114 of the developing roller 92 contact the peripheral surface of the cylindrical photosensitive layer 38*b* through the opening 118**.

Description is now given of the operation of the developing device 42 constructed as described above.

The toner-feeding roller 98 is first rotated by a drive mechanism (not shown), thereby supplying the toner 88 from the toner hopper 90 to the developing roller chamber 94 at a prescribed rate. While being transported to the developing roller chamber 94, the toner 88 has its flow rate continuously controlled to a fixed rate by the plural toner quantity-controlling blades 100. The toner 88 is forcibly positively charged by the electrode plate 102. The particles of the positively charged toner 88 are clamped between the respective hairs 114 of the developing roller 92, and then brought to the peripheral surface of the cylindrical photosensitive layer **38*b***.

The toner 88 brought to the peripheral surface of the photosensitive layer **38*b* is attracted to the first section of the cylindrical photosensitive layer 38*b* having a prescribed surface potential of minus several hundred volts. In other words, a static latent image is developed by the toner 88. The second portion of the peripheral surface of the cylindrical photosensitive layer 38*b* other than the first portion thereof retains a surface potential of about scores of volts. The toner 88 used with the developing apparatus embodying this invention has a relatively low specific resistance, and consequently is almost entirely charged. However, a certain portion of the toner particles 88 is insufficiently charged. The charged and insufficiently charged toner particles 88 brought to the peripheral surface of the cylindrical photosensitive layer 38*b* are weakly attracted to the second portion of the peripheral surface. An additional electric charge is introduced into the insufficiently charged toner particles on the peripheral surface of the cylindrical photosensitive layer 38*b*. Therefore, increasing proportions of such additionally charged toner particles 88 tend to scatter particularly to the second portion of the peripheral surface of the cylindrical photosensitive layer 38*b*. The toner particles 88 deposited on the second portion tend to give rise to fogging. As previously described, however, an A.C. field is impressed on a space defined between the electrode tube 112 surrounding the developing roller 92 and the photosensitive drum 38 with a frequency of approximately 1 kHz. This A.C. field removes the toner particles 88** deposited on the aforesaid second portion, thereby suppressing the occurrence of fogging.

With the developing apparatus of this invention used with an electrostatic copying machine, the plural toner quantity-controlling blades 100 enable the toner 88 to be continuously supplied to the electrode plate 102 used as forcible charging means at a uniform rate. Therefore, the toner 88 is always sufficiently charged, suppressing the occurrence of fogging from insufficiently charged toner 88.

Figure 8:
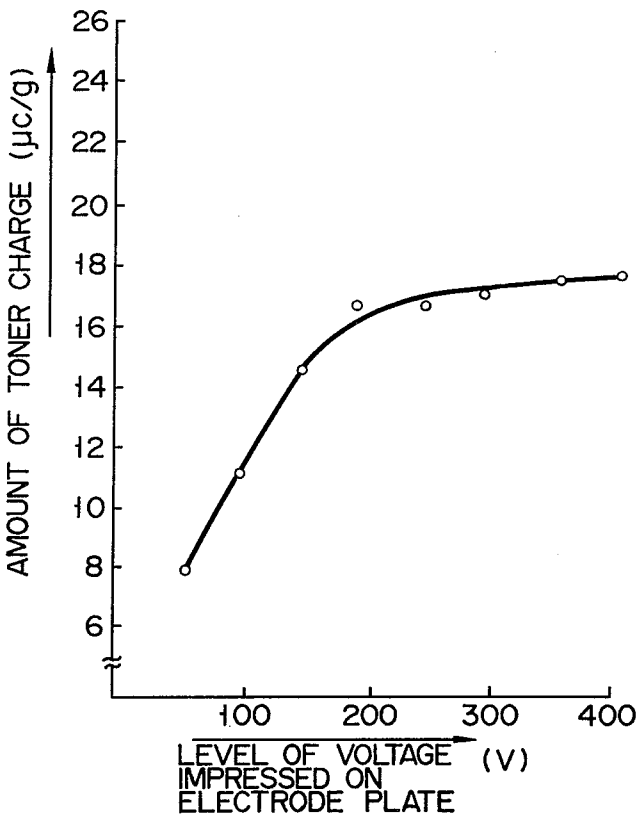
FIG. 8 is a curve diagram indicating relationship between the magnitude of voltage impressed on the electrode plate of forcible toner charging means used with the developing apparatus of FIG. 5.

FIG. 8 shows relationship between the level of voltage impressed on the electrode plate 102 and an amount of toner charge as measured by the cyclone process. With a binary toner type developing apparatus used with the conventional electrostatic copying machine which applies iron powder carriers, the toner charge stands at about 16 μc/g. Where, however, a higher voltage than 200 volts is impressed on the electrode plate 102 as applied in this invention, then the toner 88 is fully charged as seen from FIG. 8.

Insufficiently charged toner particles which are brought to the second portion of the peripheral surface of the cylindrical photosensitive layer 38*b* without being forcibly charged by the electrode plate 102, and another group of toner particles which, though forcibly charged by the electrode plate 102, yet are attracted to the aforesaid second portion by the weak surface potential thereof are shaken off the peripheral surface of the cylindrical photosensitive layer 38*b* by the action of an A.C. field impressed on a space defined between the electrode tube 112 surrounding the developing roller 92 and the aluminum cylindrical member 38*a* of the photosensitive drum 38, thereby suppressing the occurrence of fogging. To assure the complete prevension of fogging, the hairs 114 of the developing roller 92 of this invention are each formed of a conductor having a prescribed specific resistance.

Figure 9:
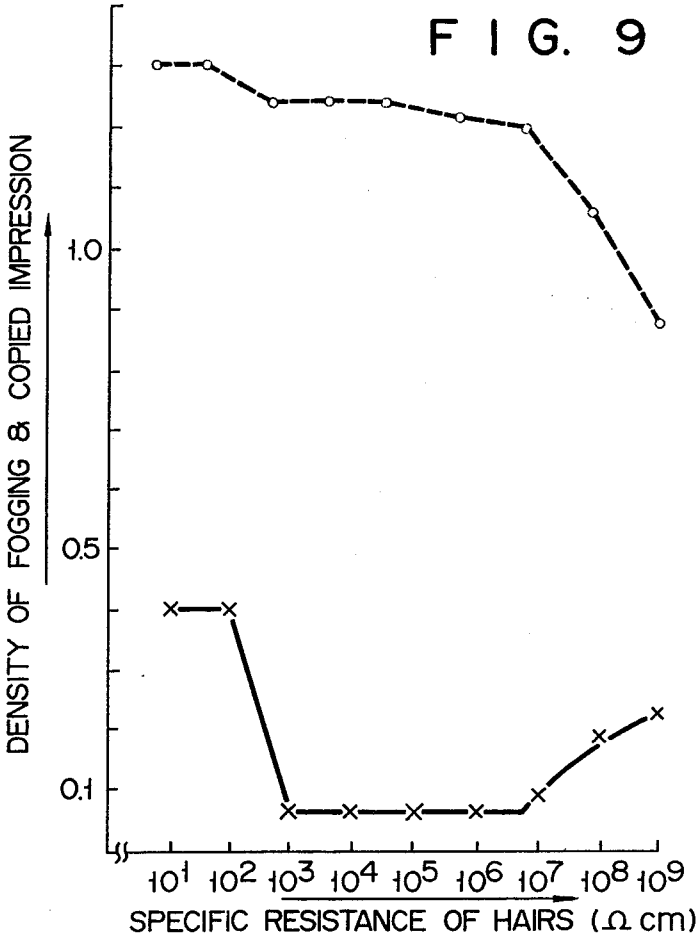
FIG. 9 is a curve diagram showing relationship between the specific electric resistance of hairs attached to a developing roller used with the developing apparatus of FIG. 5 and the density of a blurred impression.

FIG. 9 indicates the experimentally determined relationship between the specific resistance of the hairs 114 and the density of the corresponding fogging. A solid line given in FIG. 9 shows that the hairs 114 whose specific resistance ranges from $10^3$ to $10^7$ Ω.cm assure a minimum fogging density. A broken line given in FIG. 9 shows relationship between the specific resistance of the hairs 114 and the density of a copied impression. The relationship curves of FIG. 9 show that the specific resistance of the toner particles used with the developing apparatus of this invention falls within a proper range.

Figure 11:
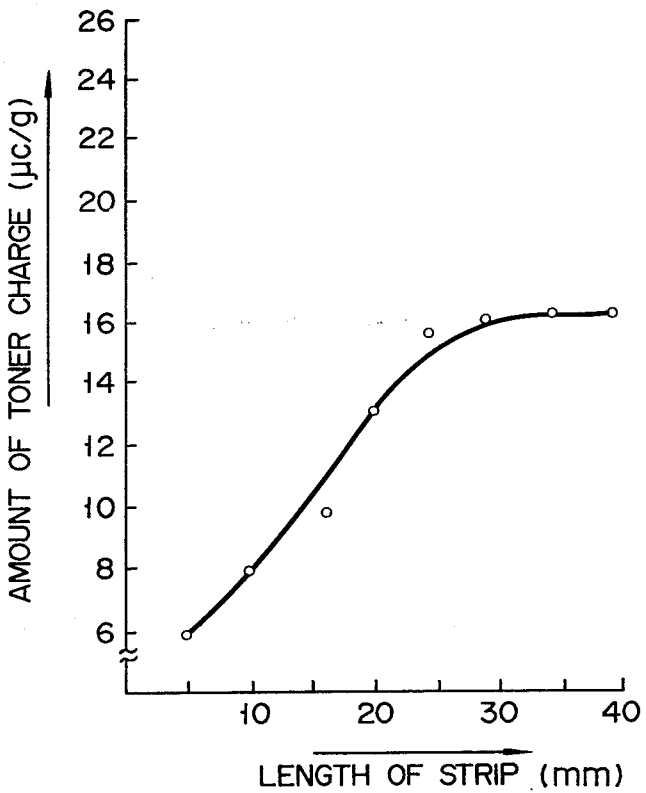
FIG. 11 is a curve diagram showing relationship between the length of a strip of forcible toner-charging means used with the developing apparatus of FIG. 10 and an amount of electric energy charged in the toner.
Figure 10:
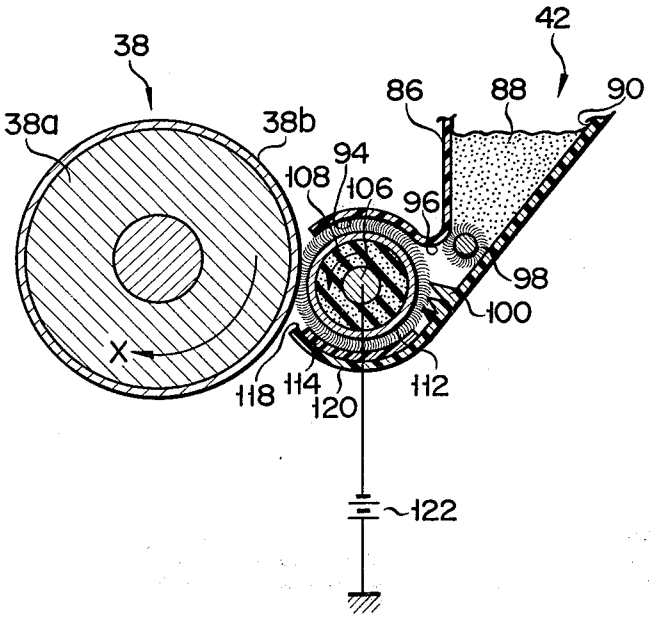
FIG. 10 schematically sets forth the arrangement of a developing apparatus according to another embodiment of the invention.

It will be noted that this invention is not limited to the foregoing embodiment, but is applicable in various modifications without departing from the scope and object of the invention. With the aforementioned embodiment, D.C. voltage was impressed on the electric plate 102 acting as means for forcibly charging the toner 88, and A.C. voltage was impressed on the electrode tube 112 acting as means for removing insufficiently charged toner particles for the object of suppressing the occurrence of fogging. Obviously, this invention is not limited to such arrangement. For example, in accordance with another embodiment of the present invention, it is possible to cause means for forcibly charging the toner 88 to be formed of a strip 120, as shown in FIG. 10, prepared from a dielectric material which is charged with the opposite polarity to that with which the toner 88 is forcibly charged. This strip 120 is prepared, for example, from ethylene tetrafluoride. Frictional contact between the toner particles 88 and the strip 120 causes the strip 120 to be negatively charged, and the toner particles 88 to be positively charged. FIG. 11 indicates experimentally determined relationship between the length of the strip 120 and the amount of toner charge. FIG. 11 shows that application of a longer strip 120 than 30 mm enables toner particles to be charged to the same extent (16 μc/g) as the conventional binary toner containing iron powder as a carrier.

Further, the electrode tube 112 acting to remove insufficiently charged toner particles for suppression of the occurrence of fogging may be supplied with D.C. voltage from the D.C. source 122 having the opposite polarity to that of the charged toner. Where such D.C. source is applied, exfoliation does not arise in that group of toner particles which is tightly attracted to the first portion of the peripheral surface of the cylindrical photosensitive layer 38*b* by the surface potential of several hundred volts thereof. However, another group of toner particles is taken off which is deposited on the second portion of the peripheral surface of the cylindrical photosensitive layer 38*b* with a weak attractive force by the surface potential of scores of volts thereof and gives rise to fogging. Therefore, the application of the above-mentioned type of D.C. source 122 is effective to suppress the occurrence of fogging.

The foregoing embodiment represents the case where the cylindrical photosensitive layer 38*b* was negatively charged, and the toner was forcibly positively charged. If, however, the material of the photosensitive layer 38*b* is properly selected, it is possible to positively charge the photosensitive layer 38*b* and negatively charge the toner.

What we claim is:

1. A developing apparatus used with an image forming system provided with a photosensitive layer on which a static latent image is impressed and which is formed of first and second portions having different surface potentials, said developing apparatus comprising:

a developing roller which is rotatably arranged and fitted with a large number of hairs for feeding a developing agent to the surface of the photosensitive layer in contact therewith, said developing agent being attracted to the first portion of the surface of the photosensitive layer with a strong attractive force and to the second portion of said surface with a weak attractive force; and means for electrically removing that portion of the developing agent which is attracted to the second portion with a weak attractive force.

2. The developing apparatus according to claim 1, wherein the developing roller is provided with a cylindrical base member formed of an elastic material; the removing means is provided with an elastic electrode tube which surrounds the peripheral surface of the cylindrical base member and is impressed with a different potential from that of the photosensitive layer; and the hairs are implanted in the outer peripheral surface of the electrode tube.

3. The developing apparatus according to claim 2, wherein the electrode tube is prepared from conductive rubber.

4. The developing apparatus according to claim 3, wherein the hairs are formed of carbon-containing fibers with a specific resistance ranging between $10^3$ and $10^7$ Ω.cm; and the conductive rubber is chosen to have a smaller specific resistance than that of the hairs.

5. The developing apparatus according to claim 4, wherein the developing agent contains a toner which is rendered chargeable by frictional contact with the hairs.

6. The developing apparatus according to claim 5, wherein said electrical removing means is provided with an A.C. source producing the potential difference from the peripheral surface of the photosensitive layer.

7. The developing apparatus according to claim 5, wherein said electrical removing means is provided with a D.C. source producing the potential difference having the opposite polarity to that of the charged toner.

8. The developing apparatus according to claim 1, 2, 3, 4, 5, 6 or 7, wherein the developing roller is rotatably supported in a housing provided with an opening; and the hairs supply the developing agent to the surface of the photosensitive layer through said opening.

9. The developing apparatus according to claim 8, wherein the housing includes toner-holding means, and means for transporting the toner from the toner-holding means to the developing roller through a toner-feeding path.

10. The developing apparatus according to claim 9, wherein the toner feeding path is provided with means for controlling the quantity of the toner supplied from the toner-feeding means and means for forcibly charging the supplied toner.

11. The developing apparatus according to claim 10, wherein the means for forcibly charging the toner comprises a strip which is prepared from a material chargeable with the opposite polarity to that of the charged toner, and is mounted on the inner wall of the housing.

12. The developing apparatus according to claim 11, wherein the strip is prepared from ethylene tetrafluoride.

13. The developing apparatus according to claim 10, wherein means for forcibly charging the toner comprises an electrode enclosed in the housing and impressed with D.C. voltage with the same polarity as that of the charged toner.

14. The developing apparatus according to claim 13, wherein the means for controlling the supply of the toner is formed of a plurality of blades which are provided between the means for forcibly charging the toner and the toner-feeding means.

15. The developing apparatus according to claim 14, wherein the plural blades are each shaped like a comb, and positioned near the means for forcibly charging the toner.

16. A developing apparatus for use with an image forming system including means for forming a static latent image having first and second portions of different surface potentials on a photosensitive layer, said apparatus comprising:

housing means defining a first chamber for holding a quantity of developing agent and a second chamber downstream of said first chamber, and including means defining a passageway for establishing communication between said first and second chambers for permitting a portion of said developing agent to flow from said first chamber to said second chamber;

a developing roller rotatably disposed in said second chamber and having means defining a dense plurality of hair-like structures extending from the circumferential surface of said developing roller for feeding said developing agent from said second chamber to the surface of said photosensitive layer, said hair-like structures contacting the surface of said photosensitive layer as said developing roller rotates in said second chamber;

charging means operatively associated with said second chamber for electrically charging said developing agent which flows into said second chamber from said first chamber, said developing agent charged by said charging means being fed to the surface of said photosensitive layer by virtue of said developing roller and, thereafter, being attracted to said first portion with a strong attractive force and to said second portion with a weak attractive force; and means operatively associated with said photosensitive layer for electrically removing the developing agent attracted to said second portion.

17. The developing apparatus as in claim 16 further comprising flow control means disposed in said passageway for controlling the flow of said developing agent from said first chamber to said second chamber at a predetermined fixed rate.

18. The developing apparatus as in claim 17 wherein said flow control means comprises means defining a plurality of spaced apart members extending into said passageway transverse to the direction of flow of said developing agent from said first chamber to said second chamber.

19. The developing apparatus as in claim 16 or 18 wherein said charging means includes electrode plate means disposed on a portion of the interior surface of said second chamber for contacting said developing agent which flows from said first chamber to said second chamber, and electrical source means connected to said electrode plate means for supplying said electrode plate means with an electrical charge and for charging said developing agent which contacts said electrode plate means.

20. The developing apparatus as in claim 16 or 18 wherein said charging means includes dielectric means disposed on a portion of the interior surface of said second chamber for charging said developing agent with a polarity opposite to that of said dielectric means in response to frictional contact between said developing agent and said dielectric means.

21. The developing agent as in claim 20 wherein said dielectric means is constructed of a dielectric material, said dielectric means consisting essentially of said material.

22. The developing agent as in claim 21 wherein said dielectric material is ethylene tetrafluoride.

* * * * *